United States Patent [19]

Höfer et al.

[11] Patent Number: 4,649,879

[45] Date of Patent: Mar. 17, 1987

[54] RPM GOVERNOR FOR FUEL INJECTION PUMPS

[75] Inventors: Gerald Höfer, Weissach-Flacht; Manfred Schwarz, Gerlingen, both of Fed. Rep. of Germany

[73] Assignee: Robert Bosch GmbH, Stuttgart, Fed. Rep. of Germany

[21] Appl. No.: 735,923

[22] Filed: May 20, 1985

[30] Foreign Application Priority Data

Jun. 30, 1984 [DE] Fed. Rep. of Germany ..... 3424268

[51] Int. Cl.[4] ..... F02M 39/00

[52] U.S. Cl. ..... 123/373; 123/449; 123/503

[58] Field of Search ..... 123/449, 503, 373, 365, 123/364

[56] References Cited

U.S. PATENT DOCUMENTS

| | | | |
|---|---|---|---|
| 3,945,360 | 3/1976 | Laufer | 123/449 |
| 3,974,812 | 8/1976 | Konrath | 123/373 |
| 4,038,958 | 8/1977 | Susuki | 123/373 |

FOREIGN PATENT DOCUMENTS

| | | | |
|---|---|---|---|
| 1815595 | 12/1968 | Fed. Rep. of Germany | 123/449 |
| 1483771 | 2/1974 | United Kingdom | 123/449 |
| 2090430 | 9/1981 | United Kingdom | 123/449 |

*Primary Examiner*—Carl Stuart Miller

*Attorney, Agent, or Firm*—Edwin E. Greigg

[57] ABSTRACT

An rpm governor for fuel injection pumps of internal combustion engines having two governor levers, namely a first lever engaged by a governor spring and a second lever which actuates the injection quantity control member and is engaged in the opposite direction from the governor spring by an rpm signal transducer, and having an intermediate spring between the two levers, is proposed, in which the intermediate spring is embodied as a spring package of relatively stiffer and softer springs in line with one another, of which the stiffer spring is effective for brief variations in force while the softer spring is contrarily effective for longer-lasting force effects. Structurally, this is attained by means of a hydraulic or pneumatic damping member (dashpot) which receives the softer spring.

3 Claims, 4 Drawing Figures

Fig.2
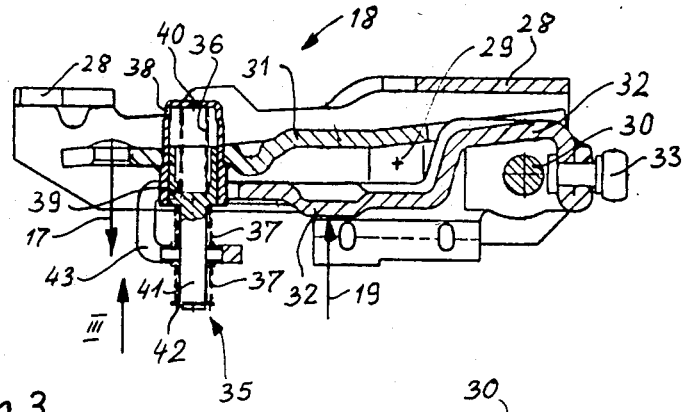
Fig.3
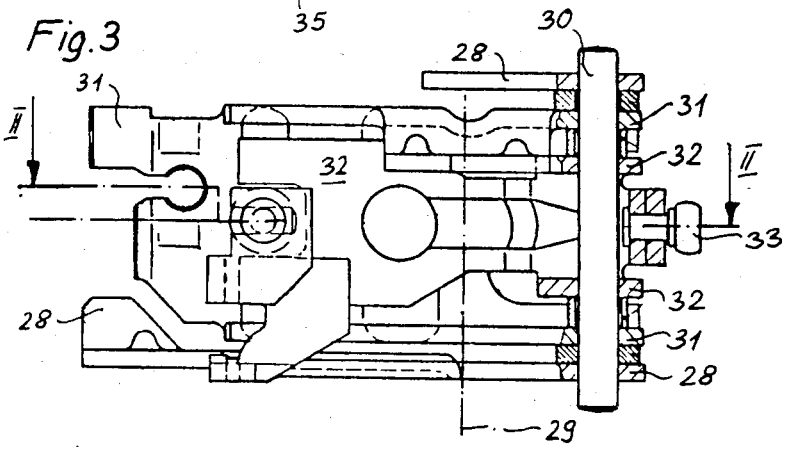
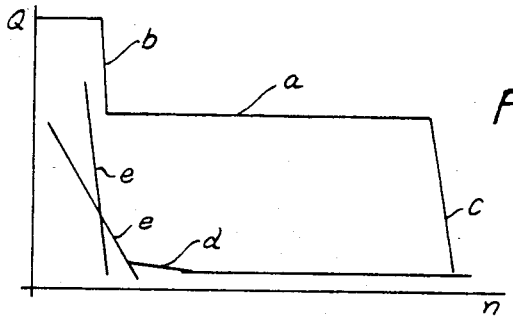
Fig.4

RPM GOVERNOR FOR FUEL INJECTION PUMPS

BACKGROUND OF THE INVENTION

The invention is based on a fuel injection pump as generally defined hereinafter. A known rpm governor of this kind (used in Bosch distributor injection pump Type VE) has, in one version, only one leaf spring as an intermediate spring, which has the function of a so-called starting spring generating an increased fuel quantity for starting; another version has a combination of this starting spring with a helical spring which governs the idling rpm. While the starting spring is as soft as possible and has the sole function of displacing the second lever and thus the injection quantity control member, in the starting position, into a position for an increased starting quantity which is greater than the maximum full-load injection quantity, the idling spring has the task, in the idling position of the governor, of keeping the second lever and thus the injection quantity control member, each acting as a counterforce to the rpm signal transducer which at idling rpm can generate only small forces, in a position that corresponds to a balance of forces (springs, rpm signal transducer).

Only when the idling rpm is exceeded, is the idling spring also compressed, so that in the upper idling rpm range the two levers rest positively on one another. The idling spring, however, is compressed via the first lever even at idling rpm and with sufficient load, to the extent that a stop determining the initial position of the first lever permits this to happen.

Naturally, a single helical or leaf spring acting as a starting and idling spring can also serve as the intermediate spring, if it is provided with a first, soft portion, for generating an increased starting quantity, and a second portion that is somewhat stiffer, for governing the idling rpm.

In a Diesel engine, the actual consumption per engine cylinder is known to vary, in contrast to the injection quantity metered per engine cylinder by the injection pump, which is identical for all the engine cylinders at a particular position of the rpm governor. The variation in the quantity usable by the engine cylinders may, during idling, amount to 30% of the average injection quantity and so is particularly disadvantageous at that time. For instance, if the average idling quantity is 5 $mm^3$, the variation may certainly amount to 2 $mm^3$. These variations, considered in dynamic terms, have a corresponding, albeit very brief, effect on the rpm of the engine, and via the rpm signal transducer of the rpm governor, on the injection quantity in turn; depending on which engine cylinder is affected by these variations, they also cause a possibly undesirable amplification or retarding of the mean idling rpm that is to be governed. For this reason, the speed droop (P-degree) should be as great as possible, which would necessitate the stiffest possible idling springs. In order to be able to travel a predetermined distance (governor path) toward a stiff spring, a relatively large variation in force is necessary, in contrast to a soft spring. As a result of the variations in the brakings and surges arising during combustion in the engine, corresponding surges of force are exerted by the rpm signal transducer onto the second lever, which can be absorbed by a stiff spring in such a way that jerking or engine jolting during idling is prevented.

However, as noted above, a stiff idling spring has a high P degree, which during idling can amount to 40%. At idling rpm levels of 600 rpm, this already accounts for 240 rpm. This high P degree causes unstable engine operation, known as "seesawing" This seesawing can be counteracted in turn by a soft spring with a correspondingly low P degree, that is, a spring in which, even at relatively small changes in force of the rpm signal transducer, long travel paths (governor paths) are already traversed. Because of the low P degree of soft springs, addition and subtraction of the slight changes in fuel quantity effected by the deviation and affecting the rpm are substantially absorbed, so that although a low P degree is attained (little seesawing, substantially constant rpm), jerking or jolting of the engine is still possible. In known rpm governors a relatively high P degree is accordingly taken into consideration so as to avoid unpleasant jerking, especially in Diesel engines for passenger cars.

In known rpm governors of the type initially described above, there is accordingly an attempt, by means of the selected stiffness of the idling spring, to strike a compromise between the least possible engine jolting and little seesawing of the engine, yet without having to increase the idling rpm.

This problem exists not only with an idling spring as the intermediate spring; it applies equally to governors of injection pumps for stationary engines or other operations needing to be governed, in which the rpm must be maintained at a constant level. Here again there is a need to avoid both seesawing on the one hand, that is, a deviation from the constant rpm, and on the other hand engine jolting, which could cause damage to the aggregate unit driven by the engine.

OBJECT AND SUMMARY OF THE INVENTION

The rpm governor for fuel injection pumps having the characteristics of the main claim has the advantage over the prior art that a governor with yielding restoration is created, in which during governed operation the brief surges effected by the deviations in engine cylinder combustion are absorbed by a stiff spring, which corresponds to the desired high P degree, yet because of the delayed action of a soft spring, a low P degree, for an rpm that is as constant as possible, can be attained. The result is a very flat characteristic curve for governed operation in the quantity/rpm diagram, merging with a correspondingly steep load increase curve, for example when accelerating from idling to higher load states. The same applies for the characteristic curve of stationary drive mechanisms.

According to an advantageous embodiment of the invention, the coupler member operates with two damping springs acting counter to one another, with the engagement point of the second lever being located floatingly between them. Both damping springs are accordingly relatively stiffly embodied, in any case stiffer than the intermediate spring. The advantage of this embodiment is the simple disposition for attaining an adaptable adjusting force for each of the two pivoting directions of the second lever, because the effect of the damping member is inherently different depending on the adjustment direction. While in one direction, the enclosed quantity must be pressed through a throttle, in the other direction it is possible for merely a negative pressure to be exerted.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 2 shows the governor lever package of FIG. 1 on an enlarged scale, in a longitudinal section taken along the line II—II of FIG. 3;

FIG. 3 is a view of the package of FIG. 2 along the arrow III in FIG. 2; and

FIG. 4 is a diagram showing the course of the injection quantity over the rpm.

DESCRIPTION OF THE PREFERRED EMBODIMENT

Figure 1:
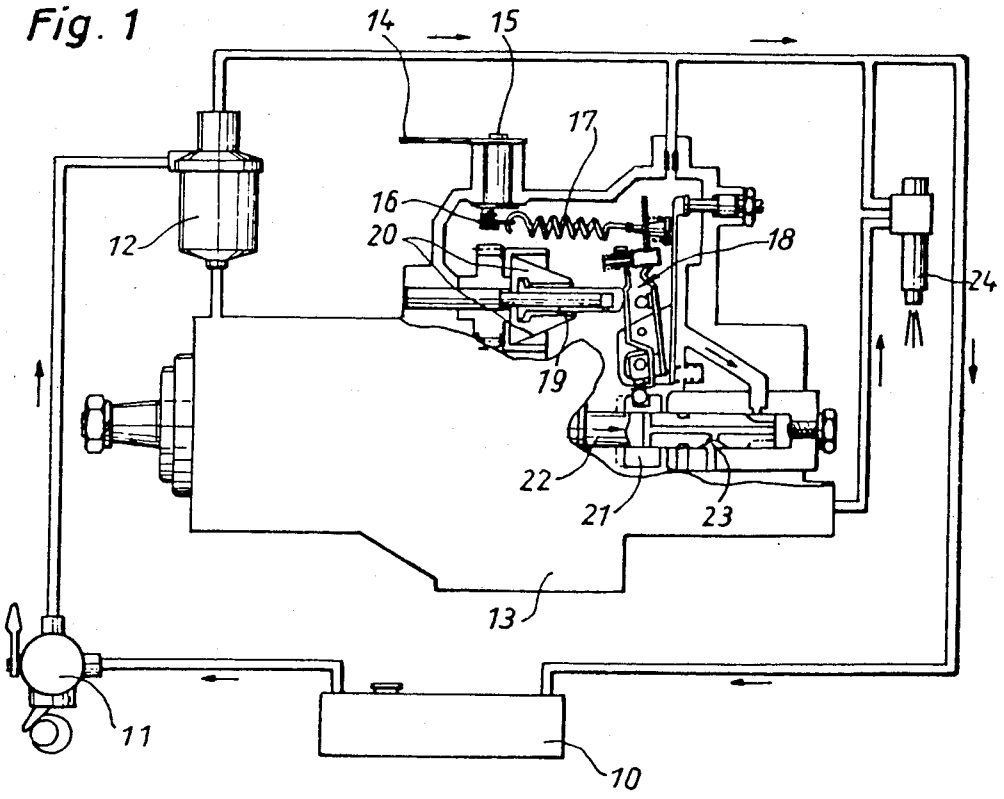
FIG. 1 shows schematically a fuel injection system having the rpm governor according to the invention.

In a fuel injection system according to FIG. 1, fuel is delivered from a fuel container 10 via a presupply pump 11 and a fuel filter 12 to a distributor injection pump 13. The housing of this particular pump is cut away for the purposes of illustration so that an important area of the rpm governor which involves this invention can be seen.

The load input, which for instance in a motor vehicle occurs arbitrarily, is performed via an adjusting lever 14, the pivoting of which is transmitted via an adjusting shaft 15 guided in the pump housing to a coupler lever 16, which is engaged by one end of a governor spring 17, the other end of which is connected to a governor lever assembly 18. Counter to the force of this governor spring 17, the governor lever assembly 18 is also engaged by an adjusting sleeve 19 of an rpm signal transducer, which is articulated by the customary flyweights 20 which are driven at rpm synchronized with the engine. The force exerted by the sleeve 19 on the governor lever assembly 18 thus varies with the rpm in accordance with a quadratic function. The governor lever assembly 18 displaces a governor slide 21, which determines the injection quantity, on a pumping and distributor piston 22. From the injection pump, the fuel is directed via a distributor groove 23 to injection nozzles 24, and the pump piston 22 executes as many compression and intake strokes per revolution as there are injection nozzles 24 or engine cylinders. For a specific position of the governor slide 21, all the engine cylinders receive the same injection quantity. As soon as the rpm increase, the injection quantity per engine cylinder is decreased by the governor, at the same load input; as soon as the rpm decrease, this injection quantity is increased.

Since when injection quantities per cylinder are the same, the engine can combust various proportions of these injected quantities per engine cylinder, a variable course of moment at the engine crankshaft results, and thus, in dynamic terms, there is a variable torque course at the engine crankshaft per engine cylinder. This effects corresponding variations in the rpm at the rpm signal transducer, so that the force with which the governor sleeve 19 engages the governor lever assembly 18 varies continuously for a brief period. The result is a correspondingly continuous minimal change in the injection quantity, which can cause jerking or jolting of the engine, since the variation in fuel quantity cannot be allocated to the corresponding cylinder. As a result, there may be an addition of the quantity in the cylinders that are already receiving too much fuel and a decrease in the quantity in cylinders that are already receiving too little. This further increases the jerking and jolting.

In FIGS. 2 and 3, a governor lever assembly 18 is shown with which this jerking can for the most part be avoided. This governor lever assembly 18 has an adjusting lever 28, which is pivotably supported at 29 in the housing and has a shaft 30. Pivoting about the point 29 effects a corresponding displacement of the shaft 30. This adjusting lever 28 is adjusted in order to vary the position of the shaft 30 and has no influence on the rpm governing.

The governor spring 17, indicated in FIG. 2 merely by an arrow indicating the force direction, engages a clamping lever 31, which is pivotably supported on the shaft 30. Also pivotably supported on the shaft 30 is a starting lever 32, on which a head 33 for articulating the governor slide 21 is provided and which is engaged by the rpm signal transducer 19 in the force direction indicated by the arrow.

Between the clamping lever 31 (first lever) and the starting lever 32 (second lever), an intermediate spring package 35 is provided, by means of which, within a specific rpm range, the pivoted position of the two levers relative to one another, and hence the fuel injection quantity, are determined in accordance with the force of spring 17 and governor sleeve 19.

This intermediate spring package 35 comprises three springs, a first, soft spring 36 and two harder, stiffer springs 37. The intermediate spring 36 is disposed in a cylinder 38 that is closed on one end. On one end, the intermediate spring 36 is supported on the closing end wall of the cylinder 38, and on the other end it is supported on a blind bore in a piston 39 which is axially displaceable in the cylinder 38. The interior of the cylinder 38 communicates with the outside through a throttle bore 40 provided in the end wall. A pin 41 is provided on the piston 39, on which pin the two stiffer intermediate springs 37—37 are guided, one of which springs is supported on the piston 39 and the other of which is mounted on a securing ring 42, which is disposed on the pin 41. The bent end 43 of the starting lever 32 is positioned between the springs 37—37 and secured in a floating manner thereby.

During brief, hard force surges originating in the rpm signal transducer, one of the stiff springs 37 intercepts these forces, the stiff springs effecting a high P degree. For these brief surges, or impacts, the coupler member, comprising the cylinder 38, the piston 39 and its pin 41, acts like a rigid system; that is, the spring 36 acts as an infinitely stiff spring, because, due to the throttling action of the throttle 40, the volume enclosed in the cylinder acts as if it were inelastic, and only at a throttle cross section corresponding to the available time does it enable the spring 36 to come into effect. As a result, the entire spring package 35 acts like a resilient, or yielding, restoration means. Over brief periods, the spring 37—37 is effective, while over long-term operation the spring 36 is effective. The result, for brief pressure changes, is a high P degree, because of the stiff springs 37, and when the change is relatively long-lasting the force 19 (or 17) produces a lower P degree, because of the softer spring 36 which is then in effect. The same applies to rapid load changes, for which a change in injection quantity is effected relatively quickly, until, after some delay, the required injection quantity is established (there is a brief excess quantity when there is a sudden increase in load).

FIG. 4 is an injection quantity/rpm diagram in which the injection quantity Q is plotted on the ordinate and the rpm n is plotted on the abscissa. The characteristic curve a indicates full load, and b designates the increased starting quantity. Curve c is the breakaway regulation course, once the maximum rpm has been attained. The transition from idling quantity to larger quantities when there is a load increase is also shown in this diagram. The decisive feature is that the governor has an idling characteristic curve d of substantially flat course, since the actual idling spring 36 is relatively soft in embodiment and effects a low P degree. As a result, engine seesawing is avoided; that is, the engine operates at a generally constant idling rpm. As soon as a load change is undertaken, a rapid increase in injection quantity with only a slight change in rpm is effected by means of the relatively stiff holding springs [i.e. for holding rpm constant] 37, as indicated by characteristic curves e.

Although according to the exemplary embodiment the problem of engine jerking and seesawing during governing of idling rpm can be solved in this way, the invention is also applicable to rpm governors for pumps of stationary engines or to corresponding problems in intermediate rpm ranges. The criterion is that by means of the rpm governor according to the invention, brief variations in force in such parameters as load or rpm result in a high P degree, while contrarily longer-lasting parameter variations result in a lower governor P degree.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An rpm governor for fuel injection pumps of internal combustion engines comprising a first lever pivotable about a shaft, a governor spring the force of which is variable in accordance with load, connected to one end of said first lever, which generates a restoring force on said first lever, a second lever which is pivotable about a shaft carried by said first lever and said second lever is form lockingly connected to an injection quantity control member for articulating said injection quantity control lever, an rpm signal transducer which acts upon said second lever which upon deflection, said first lever is pivotable against said force of said governor spring, a housing which extends through said first and second levers, a first soft spring and a second stiffer spring disposed between a rigid part and a movable part of said housing including a cylinder which forms a spring chamber which is provided with a throttle opening, said rigid part of said housing being connected to one of said first and second levers and said movable part being connected by means of said second stiffer spring to the other of said first and second levers.

2. An rpm governor as defined by claim 1, characterized in that said second spring is realized as two serially arranged springs acting by their opposite parts on said second lever and acting by their remote parts on a coupler member connected rigidly to said movable part of said housing.

3. An rpm governor as defined by claim 2, characterized in that said movable part of said housing is a piston, which is axially displaceable within said rigid part of the housing enclosing said spring chamber and said piston includes said coupler member and a tang that guides said two serially arranged springs.

* * * * *